US008833207B2

(12) United States Patent
Hanlon

(10) Patent No.: US 8,833,207 B2
(45) Date of Patent: Sep. 16, 2014

(54) GRAPHITE/TITANIUM HAMMER WITH WOODEN HANDLE

(75) Inventor: Jared W. Hanlon, Santa Clarita, CA (US)

(73) Assignee: Pull'r Holding Company, LLC, Schaumburg, IL (US)

( * ) Notice: Subject to any disclaimer, the term of this patent is extended or adjusted under 35 U.S.C. 154(b) by 400 days.

(21) Appl. No.: 13/352,200

(22) Filed: Jan. 17, 2012

(65) Prior Publication Data

US 2012/0119173 A1 May 17, 2012

Related U.S. Application Data

(63) Continuation-in-part of application No. 13/336,282, filed on Dec. 23, 2011, now abandoned, which is a continuation of application No. 12/727,762, filed on Mar. 19, 2010, now Pat. No. 8,104,379, which is a continuation of application No. 12/022,988, filed on Jan. 30, 2008, now abandoned.

(60) Provisional application No. 60/887,322, filed on Jan. 30, 2007.

(51) Int. Cl.

| | |
|---|---|
| ***B25D 1/00*** | (2006.01) |
| ***B25D 1/12*** | (2006.01) |
| ***B25D 1/04*** | (2006.01) |
| ***B25D 1/10*** | (2006.01) |

(52) U.S. Cl.

USPC ..... 81/20; 81/22; 81/489; 7/143; 7/146

(58) Field of Classification Search

USPC ..... 81/489, 20–27; 7/143–147, 167

See application file for complete search history.

(56) References Cited

U.S. PATENT DOCUMENTS

| | | | | |
|---|---|---|---|---|
| 5,341,716 | A | 8/1994 | Donohoe | |
| 5,408,902 | A * | 4/1995 | Burnett | 81/22 |
| 6,615,691 | B2 | 9/2003 | Coonrad | |
| 6,718,586 | B2 | 4/2004 | Corsini | |

FOREIGN PATENT DOCUMENTS

| | | |
|---|---|---|
| CA | 591454 | 1/1960 |

* cited by examiner

*Primary Examiner* — Bryan R Muller

(74) *Attorney, Agent, or Firm* — Cherskov Flaynik & Gurda, LLC

(57) ABSTRACT

According to disclosure, the hammer has a head made of striking grade steel. The handle comprises a 6-4 titanium hand grip and over strike plate insert in the handle and under the head. The head has an eye for accommodating a handle which in a preferred embodiment is made of a graphite titanium composite comprising from about 60 to 65% graphite by weight and from about 35 to 45% 6-4 titanium. The head of hammer has a claw end and a striking head. Also disclosed is a method of manufacturing the device of the disclosure comprising using one or more bladder compressed carbon fiber processes to anneal the graphite, titanium and steel components of the hammer.

12 Claims, 9 Drawing Sheets

10
20
22
24
30
30
32
A
B

GRAPHITE/TITANIUM HAMMER WITH WOODEN HANDLE

CROSS REFERENCE TO RELATED APPLICATIONS

This application claims the benefit as a continuation in part of U.S. Utility application Ser. No. 13/336,282 filed on Dec. 23, 2011, currently abandoned, which in turn claims the priority benefit of U.S. Utility application Ser. No. 12/727,762 filed on Mar. 19, 2010, currently patented as U.S. Pat. No. 8,104,379, issued on Jan. 31, 2012, which in turn claims the priority benefit of U.S. Utility application Ser. No. 12/022,988 filed on Jan. 30, 2008, currently abandoned, which in turn claimed priority to U.S. Provisional Application 60/887,322 filed Jan. 30, 2007.

BACKGROUND OF THE INVENTION

1. Field of the Invention

The present invention is in the area of hand-held striking tools, such as hammers, and pertains more specifically to lightweight hammers.

2. Background of the Invention

Hand-held striking tools, such as claw hammers, have been used for a variety of tasks for centuries. A hammer is basically a force amplifier that works by converting kinetic energy into mechanical work. Claw hammers typically weigh from 7 to 32 ounces, and are used for driving a target into a substrate, such as a nail into wood. The claw portion of the claw hammer also can be used to remove a target, such as a nail, or for ripping apart a substrate, such as wood or pieces of wood.

This type of hammer works as a third-class lever, with the fulcrum or pivot point being the wrist of the user, and the lever arm being the length of the hammer handle. The head, at a distance of the handle from the fulcrum, moves faster than the user's wrist, and this increased speed factored with the weight of the hammer's head and gravity has typically provided the force for driving the target into a substrate.

In the swing that precedes each hammer blow, a certain amount of kinetic energy gets stored in the hammer's head. When the hammer strikes its target, the head gets stopped by an opposite force coming from the target, for example a nail being driven into a piece of wood, which is equal and opposite to the force applied by the head to the target.

The amount of kinetic energy (KE) delivered to the target by the hammer-blow is equivalent to the mass of the head (m) times the square of the head's speed ($v^2$) at the time of impact, or $KE=0.5*m*v^2$. Increasing the speed of the hammer's head when it strikes a target exponentially increases the kinetic energy delivered to the target, thereby increasing the amount of work done with each strike of the hammer.

One way to increase the speed of the hammer's head is to increase the length of the hammer's handle. However, it is typically more difficult to accurately squarely hit a nail with a longer handled than a shorter handled hammer. Using a longer hammer may also be awkward or impossible in close spaces.

Another way to increase the hammer head's speed is to lighten the weight of the hammer itself, thereby increasing the potential speed with which a user can swing the hammer. Such a lighter hammer can then be swung faster through the arc defined by the length of the hammer's handle rotating about the fulcrum, which is typically a user's wrist.

Prior art has introduced light weight materials into the heads and handles of hammers to increase hammer speed. The drawbacks of many such materials include malleability, high cost, brittleness, tempering, vibration transmitted to the hand of the user and overall lack of durability.

The present invention comprises graphite and titanium regions in the handle that provide for flexibility and an increased strength to weight ratio.

When a hammer's handle has an increased strength to weight ratio, the weight of the head can be reduced somewhat, but the invention maintains the "head-weight" that carpenters are used to. While graphite alone is lightweight, it must be protected with titanium strike surfaces below the head of the hammer and also at the "butt" end of the handle, which is sometimes used as a striking surface. It is the object of the invention to provide a lightweight yet durable hammer that allows the user to increase the work performed by each hammer blow due to the lightness of weight of the hammer itself, and more particularly due to the strength to weight ratio of the hammer's handle.

It is a further object of the invention to provide a hammer that does not unpleasantly vibrate in the hand of the user, and that will neither dent nor crack under normal use, including when the user mis-strikes a surface and the blow lands on the handle of the hammer instead of the striking surface of the hammer's head.

It is a still further object of the invention to provide these qualities in a relatively inexpensive hammer.

It is a still further object of the invention to provide a method of assembling or manufacturing said hammer.

DESCRIPTION

According to the invention, the hammer has a head made of striking grade steel. In one embodiment, the head of hammer has a claw end and a striking head. In one embodiment, the handle comprises a 6-4 titanium hand grip and over strike plate insert in the handle and under the head. The head has an eye for accommodating a handle which in an embodiment is made of a graphite titanium composite comprising from about 60 to 65% graphite by weight and from about 35 to 45% titanium.

Also disclosed is a method of manufacturing the device of the disclosure comprising using one or more bladder compressed carbon fiber processes to anneal the graphite, titanium and steel components of the hammer.

In one embodiment, the invention comprises a hammerhead having a first end and a second end wherein said first end comprises a striking surface; a lightweight handle having graphite and titanium regions wherein said lightweight handle has a first end in communication with said hammerhead and a second end; and a titanium overstrike plate extending over the side of said handle and extending over said second end of lightweight handle wherein said titanium overstrike plate is further in communication with said hammerhead.

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

Figures 1, 5:
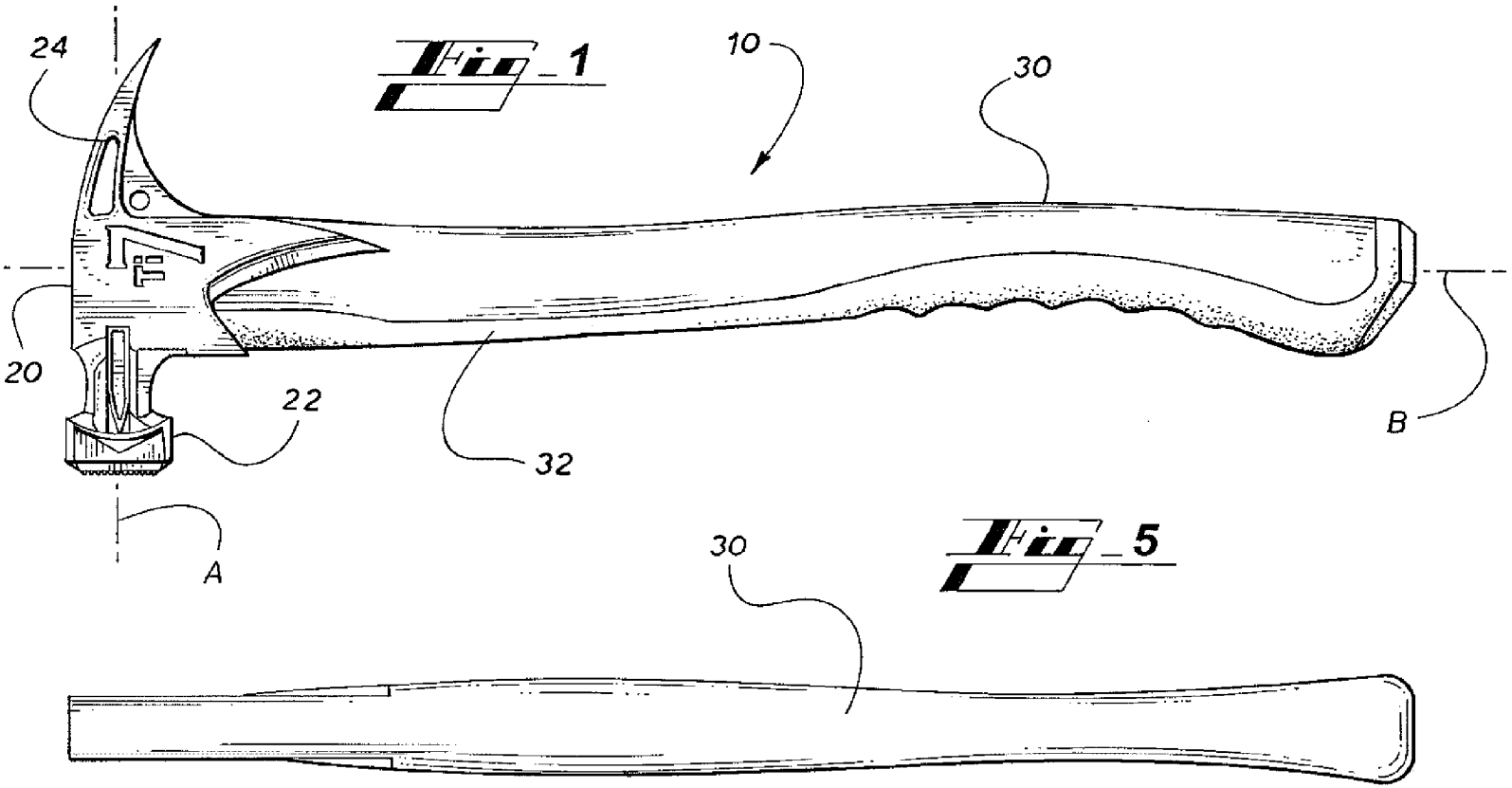
FIG. 1 is a side elevation of one embodiment of a device of the disclosure.
FIG. 5 is a plan view of the upper side of a handle of one embodiment of a device of the disclosure.

As illustrated in FIG. 1, the device of the disclosure 10 comprises a hammer head 20, and a hammer handle 30. The head defines an axis A that runs the width of the head, and the handle defines an axis B that runs the length of the handle. In one embodiment, the axes of head and handle (A,B) comprises about a 90 degree angle.

The head 20 comprises impact grade steel, and the handle 30 comprises a graphite titanium composite. In one embodiment, the handle comprises a graphite titanium and fiberglass composite. In still another embodiment, the handle 30 of the device 10 comprises a graphite titanium fiberglass and foam handle 30.

While many types of titanium can be used in the invention, at least one preferred embodiment comprises 6-4 titanium. Such 6-4 titanium may also be referred to as "grade 5" titanium, comprises a tensile strength of 130,000 psi, and comprises approximately 90 percent titanium, 6 percent aluminum, and 4 percent vanadium. However, other grades and alloys of titanium with slightly different properties may be used.

A titanium overstrike plate 39 runs the length of the handle 30 and wraps around the butt end 36 as the butt end 36 may sometimes be used as a striking surface. The overstrike plate 39 improves strength in the hammer overall by providing at least a single piece of titanium that runs the length of the handle 30 and into the head 20 of the hammer, to which the handle 30 is permanently affixed. Further, the titanium overstrike plate 39 protects the handle's integrity by resisting torque and by providing an overstrike surface to deflect misstrikes of the hammer in which the head surface does not cleanly contact the target of the hammer's head. Still further, the overstrike plate 39 reduces vibrations transmitted from the surface struck by the hammer to the user's hand and arm.

Figure 2:
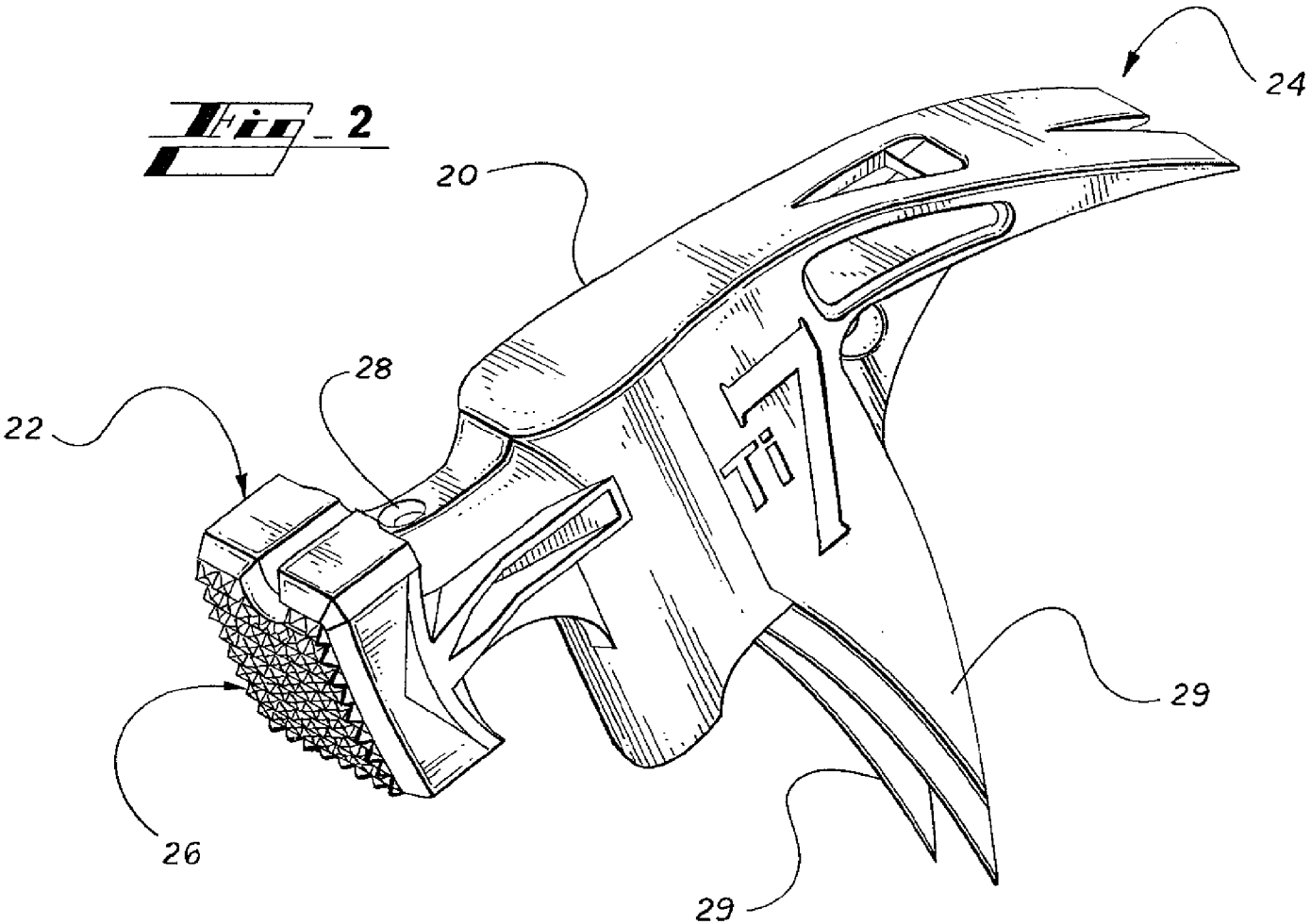
FIG. 2 is a perspective view of a head of one embodiment of a device of the disclosure.

In one embodiment of the disclosed device 10, as illustrated in FIG. 2 the head 20 of the hammer comprises one striking end 22 and one claw end 24. In another embodiment, the striking end comprises a striking surface 26 comprising a multi faceted or pyrimidal shaped surface. In still another embodiment, the striking face pattern comprises a triangle pattern or any other pattern that allows for several more points of contact than traditional striking tools. The head 20 also comprises a nail pull cavity 28 integrated into top portion of the either the striking surface, the claw, or both, which cavity is in one embodiment round or triangularly shaped.

The graphite of the device may be any type of carbon fiber. In a preferred embodiment, the carbon fiber used is standard elastic modulus type fiber (2.4-5.0 GPa tensile strength and 200-280 GPa tensile elastic modulus) or intermediate elastic modulus type fiber (3.5-7.0 GPa tensile strength and 280-350 GPa tensile elastic modulus). However, high elastic modulus fiber (2.4-5.0 GPa tensile strength and 350-600 GPa tensile elastic modulus), while typically more expensive, may also be used to good effect. The carbon fiber is currently available through Toray and Mitsubishi.

The handle 30 of the disclosed device comprises a graphite titanium composition bonded together during a bladder compressed carbon fiber process. After undergoing the bonding method, disclosed below, the graphite bonds with the titanium overstrike plate 39 and the head 20 to form a hollow shell or layer of carbon fiber. In one embodiment, that hollow shell will be filled with foam to create a foam core 38.

In one embodiment, the handle 30 comprises a graphite titanium composite comprising from about 60 to 75% graphite by weight and from about 25 to 35% titanium. In another embodiment, the handle 30 comprises a graphite, fiberglass and titanium composite comprising from about 40 to 55% graphite by weight, about 20-30% fiberglass by weight and from about 25 to 35% titanium by weight. In still another embodiment, the handle comprises a graphite, fiberglass, a medium density cellulose foam and titanium composite comprising from about 35 to 45% graphite by weight, about 25 to 35% fiberglass by weight, about 15 to 25% foam by weight and from about 25 to 35% titanium by weight.

The graphite is bonded to the titanium and other composite components during a bladder compressed molding process. A negative mold is created of the entire device of the disclosure, including the head 20. In one of the preferred embodiments, graphite fibers comprising a graphite cloth are layered onto a prepared mold section according to the direction of the carbon fibers. The number of layers of carbon cloth corresponds to the desired strength needed at that position of the hammer's handle 30.

In one embodiment, carbon fibers embedded in the handle 30 of the disclosed device 10 run perpendicular or parallel to the longitudinal axis of the handle 30 or to the width of the head 20 of the device of the disclosure. In another embodiment, about 50% of the cloth's carbon fibers run parallel to the axis defined by the head A but perpendicularly to the axis defined by the handle B and about 50% run parallel to the axis defined by the handle B but perpendicularly to the axis defined by the head A.

Figure 3:
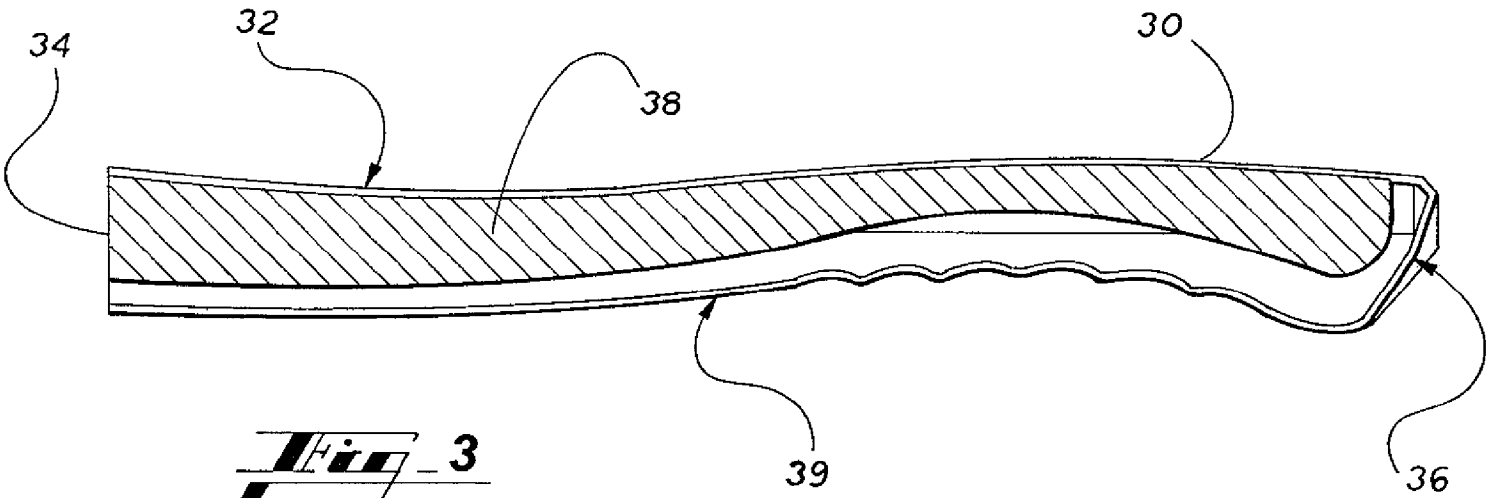
FIG. 3 is a sectional view along line A-A of FIG. 4 of one embodiment of a device of the disclosure.

As illustrated but not to scale in FIG. 3, the thickness of the layer or layers of woven fibers 32 forming the shell of the handle 30 may vary at different positions between the end of the handle inserted into the striking head 20 and the butt end 36 of the handle. In one embodiment, the thickness of the layers 32 varies from about 0.035" to about 0.065.

The use of graphite and titanium, with or without the other fiberglass and foam components, provides a lightweight, strong handle that reduces the vibration transmitted from the hammer's head to the hand and arm of a user. Use of fiberglass decreases cost of production. Use of a foam core 38 further strengthens the integrity of the handle, and therefore of the device of the disclosure itself, and also further reduces vibration and impact felt by a user during use of the disclosed device. In one embodiment of the device disclosed, a medium density cellulose foam is used.

Figure 4:
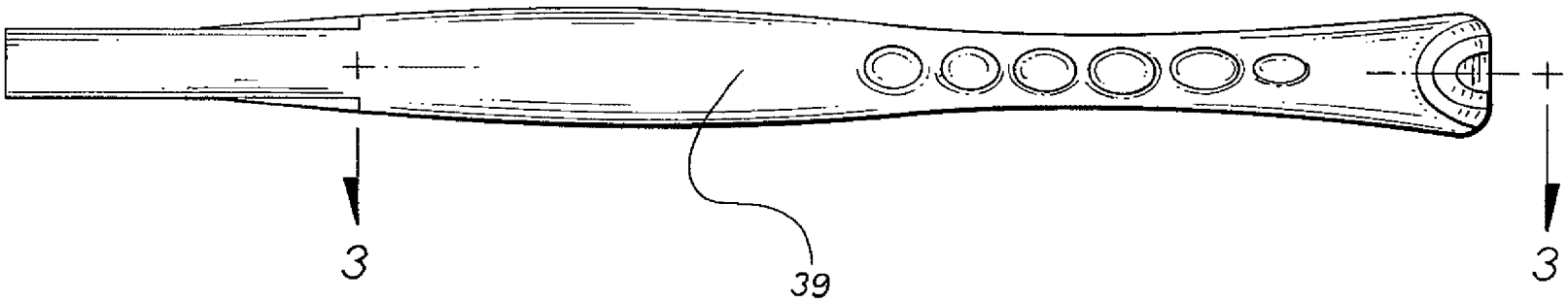
FIG. 4 is a plan view of the underside of one embodiment of a device of the disclosure.

The titanium overstrike plate 39 of the handle, as illustrated in FIGS. 3 and 4, and the hammer's steel head 20 are included in the compression/bladder mold with the arranged carbon fibers, and through processing, all components are molded and bonded together. The processing may be conducted at 250 to 400 degrees Fahrenheit, from about 10-12 psi, and for about 2½ to about 3½ hours during which the elements are processed under heat and pressure.

After molding has been completed, a plastic overlayer is added to the entire device to protect the device 10 from disfiguration.

The compression/bladder mold requires all of the elements of the device 10 including its head 20, typically comprised of impact grade steel, the overstrike plate and hand grip of titanium 39, and the handle 30 to be molded together as a single unit. Additionally, as illustrated in FIG. 2, supports 29 extending from the head 20 strengthen the handle 30 and aid in the elimination of perpendicular moment created by existing striking tool assembly.

Also disclosed is a method of manufacturing the disclosed device. That method comprises constructing a handle 30 comprising a graphite titanium composite and a titanium overstrike plate 39; constructing a striking grade steel head 20; and joining the striking head 20 to the handle 30.

The graphite used in the method may comprise carbon fibers or carbon fibers woven into a cloth. The fibers of the cloth may be arranged perpendicularly.

The graphite is bonded to the titanium used in the method by heating the fibers in a compression-bladder mold with the titanium. The hammer's steel head 20 is also permanently attached to the handle 30 during this molding step.

In another embodiment of the method of the disclosure, the method of manufacturing the disclosed device comprises:

1. creating a negative mold of a hammer 10, which mold comprises a top section and a bottom section;
2. applying petroleum jelly to the insides of the top and bottom sections of the mold;
3. creating an impact grade steel hammer head 20, the head comprising an orifice for receiving and bonding to a hammer handle 30;
4. providing an epoxy bonding material within the orifice, the epoxy adapted to permanently bond the head 20 and handle 30 together;
5. placing the head 20 in the bottom section of the mold;
6. creating a titanium overstrike plate 39 comprising an striking surface and a bonding surface, which striking surface is adapted to cover at least the length of the handle from below the striking surface of the head to an end of the handle opposite the head;
7. providing an epoxy bonding material on the bonding surface of the plate 39, the epoxy adapted to permanently bond the plate with graphite;
8. positioning the overstrike plate 39 within the bottom section of the mold;
9. arranging woven carbon fiber material in the bottom section of the mold to a depth of about 0.035" to about 0.065" thick;
10. arranging woven fiberglass pieces previously dipped in a doping compound on top of the carbon fiber material;
11. placing a high temperature bladder on top of the fiberglass;
12. wrapping the carbon material over the ends and edges of the bladder;
13. repeating steps a through d, inclusive, for the top section of the mold;
14. placing the top and bottom sections of the mold together and securing them together;
15. inflating the bladder to a pressure of about 10 to about 12 psi;
16. placing the mold in an oven heated to about 250 to about 400 degrees Fahrenheit for about 2.5 to 3.5 hours while maintaining the pressure within the bladder;
17. removing the mold from the oven and allowing the bladder to deflate;
18. extracting the molded hammer 10 from the mold;
19. introducing fluid medium density cellulose foam 38 into the cavity created by the removed bladder and permitting the foam to harden; and
20. coating the hammer with a plastic layer adapted to protectively coat the hammer.

An alternative embodiment of the invention is depicted in FIGS. 6-9. The alternative embodiment shown in FIG. 6 comprises a striking device 60 having a handle 80 and hammer head 70. The hammer head 70 defines a handle aperture 71. A top portion 81 of the handle 80 is inserted into the head 70 such that the handle 80 extends through the aperture 71. The extending top portion 81 of the handle 80 is the end of the handle 80 which is opposite of the butt end 86 of the handle 80.

The handle 80 defines four sides. The side of the handle 80 which faces the striking surface 76 of the head 70 is the striking side of the handle 82. A cross section of the handle 80 is shown in FIG. 7B and is discussed below.

Figure 6:
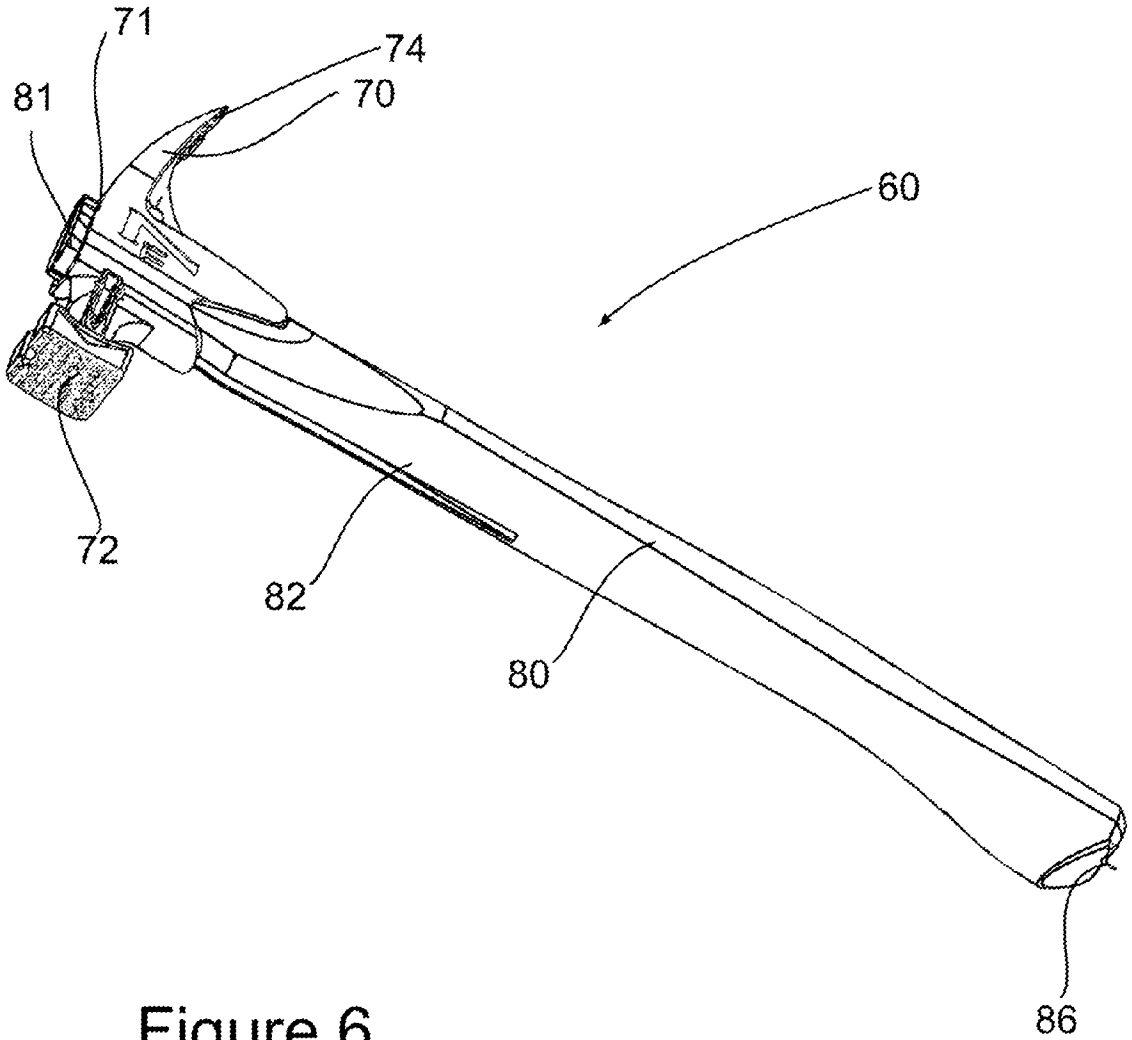
FIG. 6 is a side elevation of another embodiment of a device of the disclosure.

In the embodiment shown in FIG. 6, the handle 80 comprises a coated wood composite, which is described fully below. The core of the handle 80 is a solid piece of hardwood, in one embodiment. As will be discussed below, the hardwood core is surrounded by a sleeve which is applied thereto, in one embodiment.

Figure 7A:
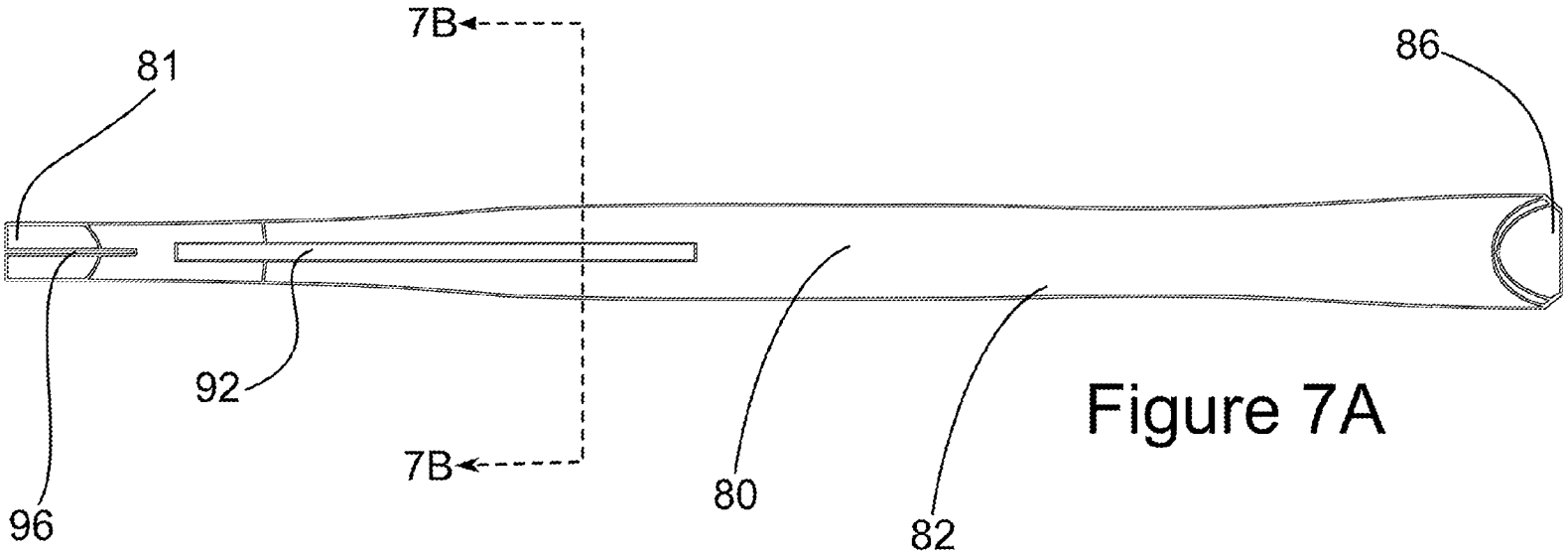
FIG. 7A is a plan view of a handle of one embodiment of a device of the disclosure.
Figure 7B:
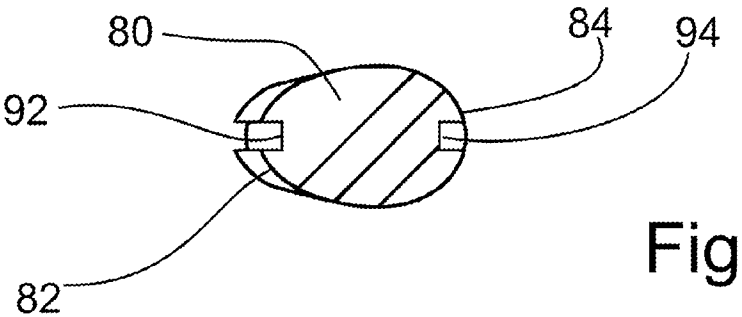
FIG. 7B is a sectional view along line 7B-7B of FIG. 7A of one embodiment of a device of the disclosure.

FIG. 7A depicts the striking side 82 of the hammer handle 80. The hammer handle 80 extends from the handle butt end 86 to the portion of the handle 81 which extends out of the hammer head upon installation. A striking side notch 92 is etched into the surface of the handle 80 striking side 82. The striking side notch 92 receives a striking side bolt. In one embodiment, the striking side bolt is a piece of titanium roughly the size of the striking side notch 92. In one embodiment, the striking side bolt 92 is maintained in place within the notch through the application of adhesive. In another embodiment, the bolt remains inside of the notch due to a snug-fit connection with the notch 92 or due to frictional engagement into the sides of the notch 92.

The handle 80 top portion 81 which extends through the head following installation of the handle defines another notch—the head installation notch 96. The head installation notch 96 allows the handle portion 81 to compress during installation. In one embodiment, a screw, wedge, or other fastening member is driven through the notch 96 after installation to cause an expansion of the notch 96, which in turn results in the expansion of the handle portion 81. Such expansion secures the handle portion 81 within the handle aperture 71 without the use of an adhesive in the connection of the head and handle. The head installation notch 96 further ensures that the handle portion 81 is able to expand and contract in response to changes in temperature and pressure. Room for the expansion and contraction is necessary to ensure that the wooden core of the handle 80 remains in place after encapsulation by the head 70 by sliding the handle 80 into the handle-receiving aperture 71.

FIG. 7B is a cross-sectional depiction of the hammer handle 80 along line 7B-7B shown in FIG. 7A. As can be seen in FIG. 7B, the striking side 82 of the handle 80 defines one notch—the striking side notch 92. Similarly, the opposite side of the handle 80 (the side not visible in FIG. 7A), or the handle claw side 84 also defines a notch—the claw side notch 94. Analogously to the use of a titanium bolt within the striking side notch 92, a different bolt is inserted into the claw side notch 94. In the embodiment shown in FIG. 7B, the striking side notch 92 extends deeper into the handle 80 and therefore the striking side notch 92 receives a larger bolt than the claw side notch 94. In other embodiments, the claw side notch 94 receives the same size bolt and so the two notches 92, 94 are substantially the same depth and length.

Figure 7C:
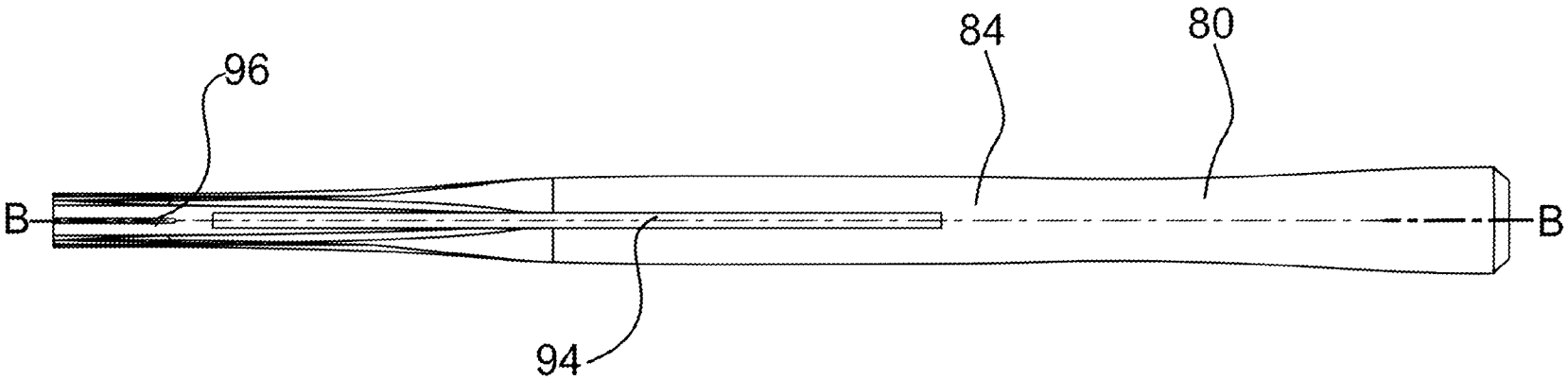
FIG. 7C is another plan view of a handle of one embodiment of a device of the disclosure.

The claw side 84 of the handle 80 is depicted in FIG. 7C, pursuant to one embodiment of the invention. The claw side 84 defines a notch 94. The claw side notch 94 spans the horizontal axis B of the handle 80. In the embodiment shown in FIG. 7C, the claw side notch 94 extends approximately one-half of the total length of the hammer handle 80. In one embodiment, the striking side notch 92 (shown in FIG. 7A) extends over a shorter amount of length of the handle 80, approximately one third of the total length. In other embodiments, not shown, the claw side notch 94 and the striking side notch 92 are approximately the same lengths.

Upon insertion of its metal bolt, and following the installation of the handle 80 into the head 70, the wooden main body of the handle 80 is both reinforced and protected by the use of the rods. In one embodiment, the metal inserted into the notches is titanium. The handle 80 is protected by the presence of titanium in the striking side notch 92 inasmuch as the titanium on that side of the handle will absorb any mis-strikes acting as an overstrike plate. The handle 80 is strengthened by the titanium in the claw side notch 94 inasmuch as the claw side titanium absorbs vibrations from the hammer striking a work piece, significantly increasing the strength of the spine of the hammer handle 80.

As shown in FIG. 7C, the head installation notch 96 extends through the handle 80 starting on the striking side 82 of the handle 80 and extending through to the claw side 84 of the handle 80.

Figure 8:
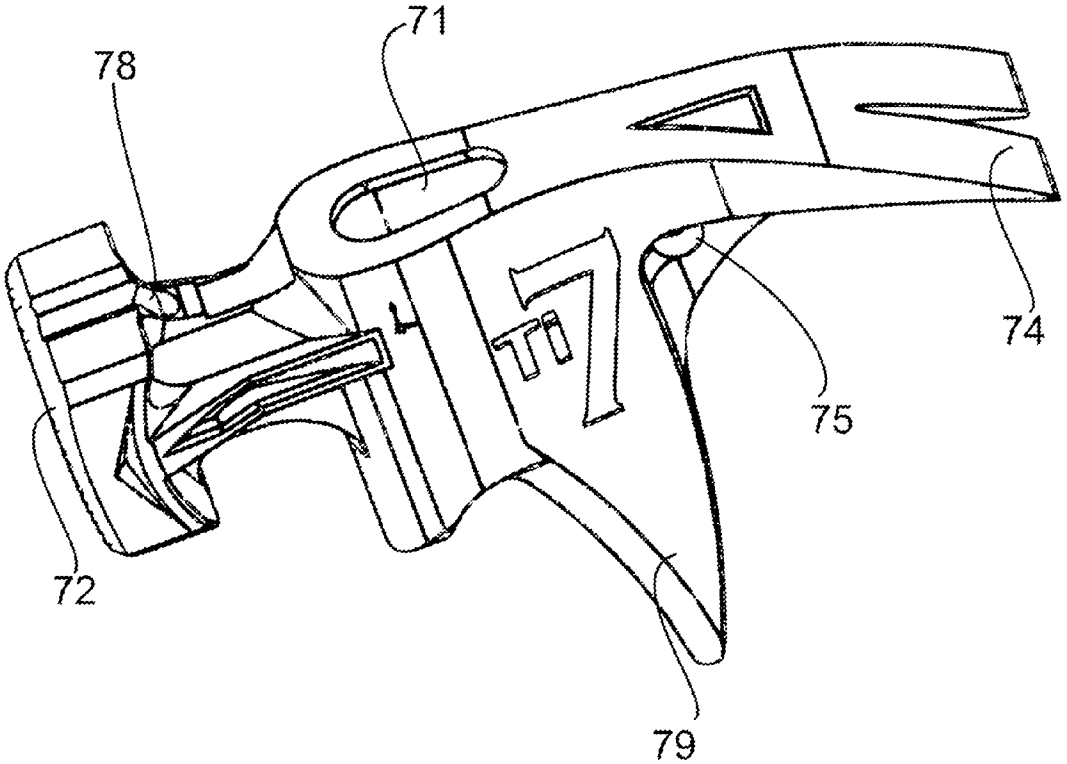
FIG. 8 is a plan view of the hammer head of one embodiment of the device of the disclosure.

Details of the head 70 features are shown in FIG. 8. The hammer head 70 defines a claw end 74 and a striking end 72. A nail pulling cavity 78 is defined at the surface of the hammer head 70 which is perpendicular to the striking surface 72. An aperture 71 extends through the body of the hammer head 70 to facilitate installation of the handle into the hammer head 70. The hammer head 70 further defines two supports 79. The head supports 79 prevent the hammer head 70 from breaking off the handle 80 when prying force is applied to the sides of the handle—i.e. when prying force is applied to the head perpendicular to the claw end 74.

The head 70 further defines a hanging aperture 75 to allow hanging of the assembled hammer from its head.

Figure 9:
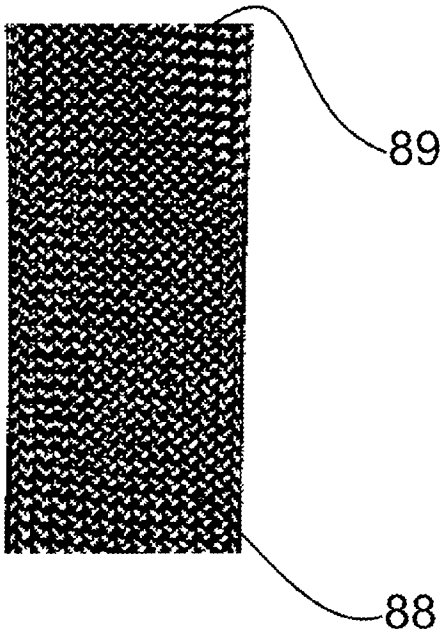
FIG. 9 is a depiction of a segment of the handle sheath used with one embodiment of the device.

FIG. 9 shows a segment of the sleeve 88 that is used to encapsulate the handle 80, in one embodiment. The sleeve 88 is defined by a weave pattern 89 of overlapping strands of fiber. In one embodiment, the sleeve 88 weave pattern 89 is created by overlapping basalt fibers or yarns. The sleeve 88 formed from basalt fibers protects the main body of the hammer handle 80. The basalt fiber extends over the entire length of the hammer handle 80 from the portion 81 which extends out of the head aperture 71 wrapping around the butt end 86 of the handle 80. The weave pattern 89 allows the sleeve to expand slightly during installation over the handle 80, constricting once the sleeve 88 is in place. The sleeve prevents splintering of the wooden core, increases the useable life of the handle, and creates high temperature resistance along with chemical and corrosion resistance. The sleeve also provides additional padding for the end user of the hammer handle 80. In other embodiments, the sleeve 88 comprises other protective woven materials, such as carbon fibers, various natural cloth fibers (such as burlap), or man-made fibers.

The manufacturing process of the alternative embodiment comprises several steps.

The handle and the head are formed separately, in one embodiment. Turning to the handle, the main body of the handle 80 is formed from a single piece of hardwood, in one embodiment. In other embodiments, a wood composite material is used. Once the wood source block is shaped into the shape of the handle 80 as shown in FIG. 6, notches in the striking and the claw sides are added. Finally, the head installation notch is added to the top of the handle wherein the top of the handle is the end opposite of the butt end.

Figure 10:
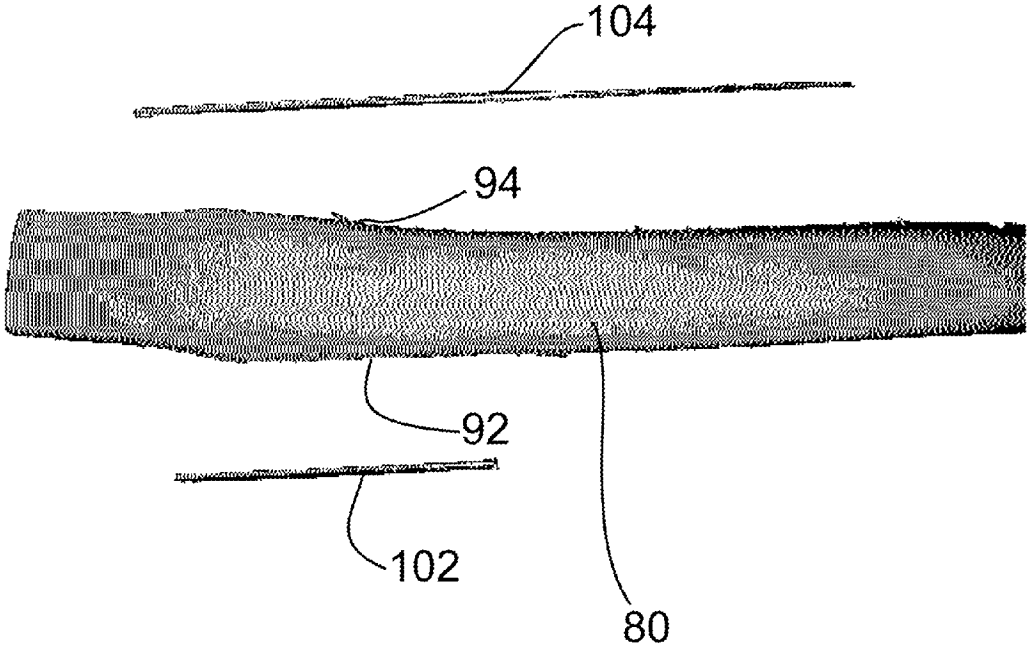
FIG. 10 is a depiction of an embodiment of the device during the manufacturing process of same.

Following the addition of the notches, the woodworking portion of the manufacturing process is completed. Next, two pieces of metal, such as titanium are inserted into the striking side notch and the claw side notch. In one embodiment, these two notches are filled with a fiberglass material instead of titanium. The metal rods are kept in place through frictional engagement within the notches, in one embodiment. In another embodiment, the two rods are glued into place with an adhesive or an epoxy. The wooden handle 80 with its notches 96 and 94 along with the metal bolts corresponding to the notches 102, 104 immediately prior to installation of bolts within the notches is shown in FIG. 10. The bolts 102, 104 need not be perfectly straight and have an entirely consistent outer surface inasmuch as they are epoxied-into place in the embodiment shown in FIG. 10. Further, if either notch is not exactly the right size, which results in one of the bolts protruding somewhat from the outer edge of the handle, the final surface of the handle is equalized by the addition of the sleeve shown in FIG. 9.

The handle 80 is subsequently covered by a sleeve. In one embodiment, the natural expansion and contraction of the sleeve keeps the sleeve in place. In other embodiments, the sleeve 88 is kept in place by epoxy adhesive applied to the length of the handle prior to the application of the sleeve 88 over the handle 80. In one embodiment, a basalt sleeve is applied over the handle. In another embodiment, a fiberglass sleeve extended over the handle.

As part of the preparation of some embodiments, the handle is painted following the application of the sleeve. Further, a logo, part number, or a warning label may be added to one or more surfaces of the handle. In one embodiment, the paint creates a glossy finish on the hammer handle that further protects the wooden core and basalt sleeve from problems such as water damage. In other embodiments, a matte finish is applied to the handle. In further embodiments, the sleeve is left in its original outer surface.

At the time the handle is being prepared, the hammer head may likewise be fashioned in a conventional manner, with the key elements being the side hammer head supports and the handle-receiving aperture. In one embodiment, the hammer head is made out of striking-grade steel and other suitable materials.

Once the handle and sleeve combination is dry, the handle is inserted into the hammer head handle aperture. The handle is secured in place by driving a wedge into the head installation notch. In another embodiment, a screw is driven into the head installation notch.

The end result is that the handle is secured into the hammer head without using adhesive in the handle/head connection, facilitating the expansion and contraction of the wood core of the head. In those embodiments where a screw is used, the handle is removable and replaceable as needed.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

The embodiment of the invention in which an exclusive property or privilege is claimed is defined as follows:

1. A lightweight hammer comprising:

a hammer-head having a first end and a second end wherein said first end comprises a striking surface;

a lightweight handle having a basalt sleeve and at least one wood region wherein said lightweight handle has a first end in communication with said hammer-head and a second end; and at least two titanium rods extending over at least two sides of said handle.

2. The lightweight hammer of claim 1 wherein said hammer-head comprises striking grade steel.

3. The lightweight hammer of claim 2 wherein said hammer-head further comprises an aperture defined in a first surface of said hammer-head.

4. The lightweight hammer of claim 1 wherein a hammer-head axis is defined by the middle of the width of the hammer-head and a handle axis is defined by the middle of the length of the handle wherein a 90 degree angle is formed by an intersection of the hammer-head axis and the handle axis.

5. The lightweight hammer of claim 1 wherein said titanium rods comprise 6-4 titanium.

6. The lightweight hammer of claim 1 wherein said hammer-head is permanently affixed to said lightweight handle.

7. The lightweight hammer of claim 1 wherein said hammer-head second end comprises a claw structure.

8. The lightweight hammer of claim 1 wherein said hammer-head further comprises a means for pulling nails.

9. The lightweight hammer of claim 4 wherein titanium rods are bonded to said lightweight handle wherein said lightweight handle comprises a wood core.

10. The lightweight hammer of claim 1 wherein said at least one wood region comprises a wood core disposed through the length of the lightweight handle.

11. The lightweight hammer of claim 1 wherein basalt sleeve comprises cross-hatched basalt fibers.

12. The lightweight hammer of claim 1 further comprising a cellulose material disposed through the length of the lightweight handle.

* * * * *